US010436443B2

(12) United States Patent
Sugatani

(10) Patent No.: US 10,436,443 B2
(45) Date of Patent: Oct. 8, 2019

(54) CLOSING MEMBER AND EXHAUST STRUCTURE FOR COMBUSTION APPARATUS

(71) Applicant: NORITZ CORPORATION, Hyogo (JP)

(72) Inventor: Masaki Sugatani, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 729 days.

(21) Appl. No.: 15/083,846

(22) Filed: Mar. 29, 2016

(65) Prior Publication Data

US 2017/0284665 A1 Oct. 5, 2017

(51) Int. Cl.
*F23J 13/00* (2006.01)
*F23J 13/02* (2006.01)

(52) U.S. Cl.
CPC ..... *F23J 13/025* (2013.01); *F23J 13/02* (2013.01); *F23J 2213/101* (2013.01); *F23J 2213/204* (2013.01); *F23J 2213/302* (2013.01)

(58) Field of Classification Search
CPC ..... F23J 13/0258; F16L 7/02
USPC ..... 248/49, 65, 68.1, 71, 73, 200; 52/712, 52/714, 715, 292; 285/109, 110, 124.2
See application file for complete search history.

(56) References Cited

U.S. PATENT DOCUMENTS 717,592 A 1/1903 Melsha
1,328,647 A 1/1920 Carl
3,209,670 A 10/1965 Twickler
4,886,228 A * 12/1989 Kennedy ..... H02G 3/24 248/74.1
5,286,040 A 2/1994 Gavin
5,649,712 A 7/1997 Ekholm
6,634,675 B2 10/2003 Parkes
7,150,437 B1 * 12/2006 Teeters ..... F16L 3/04 248/70
2015/0056903 A1 2/2015 Nagano et al.

OTHER PUBLICATIONS

A Non-Final Office Action issued by the United States Patent and Trademark Office dated Aug. 7, 2018, which corresponds to U.S. Appl. No. 15/097,903 and is related to U.S. Appl. No. 15/083,846.
A Non-Final Office Action issued by the United States Patent and Trademark Office dated Aug. 27, 2018, which corresponds to U.S. Appl. No. 15/097,865 and is related to U.S. Appl. No. 15/083,846.

* cited by examiner

*Primary Examiner* — Steven M Marsh
(74) *Attorney, Agent, or Firm* — Studebaker & Brackett PC

(57) ABSTRACT

A closing member includes an annular portion and a flange portion. The annular portion is provided with a through hole and is in contact with an outer circumferential surface of an exhaust tube in at least a part of the through hole. The flange portion extends from an outer circumferential surface of the annular portion toward an outer side and is larger in outer diameter than an exhaust pipe. The flange portion contacts a tip end portion of the exhaust pipe on outside of a building so as to close a gap between the exhaust pipe and the exhaust tube. The flange portion is formed to protrude toward an outer side such that an entire circumference of the flange portion extends beyond an outer circumferential surface of the tip end portion of the exhaust pipe.

7 Claims, 14 Drawing Sheets

CLOSING MEMBER AND EXHAUST STRUCTURE FOR COMBUSTION APPARATUS

BACKGROUND OF THE INVENTION

Field of the Invention

The present invention relates to a closing member and an exhaust structure for a combustion apparatus.

Description of the Background Art

A combustion apparatus, for example, a water heater, a heating apparatus and the like, has a main body that is placed inside of a building. The exhaust gas generated from combustion in such a combustion apparatus is generally discharged through an exhaust pipe (B vent) from a roof of a residential house to the outside thereof.

There are locations where an already-placed exhaust pipe cannot be removed, from a point of view of maintaining appearance of buildings, when this already-placed tank water heater should be replaced with a new instantaneous water heater.

At such a location, a new exhaust tube (a flexible exhaust tube) is inserted into the already-placed exhaust pipe without removing this already-placed exhaust pipe, so that a combustion apparatus can be replaced. It is known that such a new exhaust tube is held using an exhaust adapter disclosed in US 2015/0056903A1. On the other hand, when outside air enters the exhaust pipe through a gap between the exhaust pipe and the exhaust tube on the outside of the building, dew condensation may occur within the exhaust pipe inside the building. Accordingly, it is desired to suppress the outside air from entering through a gap between the exhaust pipe and the exhaust tube on the outside of the building. Also, some exhaust pipes that have been already placed may have openings mainly with diameters of 3 inches and 4 inches. Such opening diameter differences also need to be addressed.

SUMMARY OF THE INVENTION

The present invention has been made in light of the above-described problems. An object of the present invention is to provide a closing member and an exhaust structure for a combustion apparatus, by which outside air can be suppressed from entering through a gap between an exhaust pipe and an exhaust tube on the outside of a building.

The closing member of the present invention serves to close the gap, on outside of the building, between the exhaust pipe extending from inside to outside of the building and the exhaust tube inserted into the exhaust pipe. The closing member includes an annular portion and a flange portion. The annular portion is provided with a through hole and is in contact with an outer circumferential surface of the exhaust tube in at least a part of the through hole. The flange portion extends from an outer circumferential surface of the annular portion toward an outer side, and is larger in outer diameter than the exhaust pipe. The flange portion contacts a tip end portion of the exhaust pipe on outside of the building so as to close the gap between the exhaust pipe and the exhaust tube. The flange portion is formed to protrude toward the outer side such that an entire circumference of the flange portion extends beyond an outer circumferential surface of the tip end portion of the exhaust pipe.

According to the closing member of the present invention, the flange portion is formed to protrude toward the outer side such that an entire circumference of the flange portion extends beyond the outer circumferential surface of the tip end portion of the exhaust pipe. Accordingly, the flange portion comes in contact with the tip end portion of the exhaust pipe, so that the gap between the exhaust pipe and the exhaust tube can be closed. Thereby, irrespective of the opening diameter of the exhaust pipe, the outside air can be suppressed from entering through the gap between the tip end portion of the exhaust pipe and the exhaust tube, so that the outside air can be suppressed from entering through the gap between the exhaust pipe and the exhaust tube on the outside of the building.

In the above-described closing member, the annular portion includes a first annular member and a second annular member that is larger in outer diameter than the first annular member. Thereby, since each of the first annular member and the second annular member can be arranged inside various exhaust pipes with different sizes, the closing performance for various exhaust pipes with different sizes are improved.

In the above-described closing member, the first annular member is arranged on a first side of the flange portion and the second annular member is arranged on a second side of the flange portion that is opposite to the first side of the flange portion. Thereby, each of the first annular member arranged on the first side of the flange portion and the second annular member arranged on the second side of the flange portion can be arranged inside various exhaust pipes with different sizes.

In the above-described closing member, the flange portion includes a first flange member and a second flange member that is larger in outer diameter than the first flange member. The first annular member is arranged on a first side of the first flange member and the second annular member is arranged on a second side of the first flange member that is opposite to the first side of the first flange member. The first flange member is arranged on a first side of the second annular member and the second flange member is arranged on a second side of the second annular member that is opposite to the first side of the second annular member. Thereby, the first annular member can be arranged inside the exhaust pipe while the first flange member is in contact with the tip end portion of the exhaust pipe. Also, the second annular member can be arranged inside the exhaust pipe while the second flange member is in contact with the tip end portion of the exhaust pipe.

In the above-described closing member, the flange portion is provided with a first annular groove. The first annular groove surrounds the through hole and is provided in an end face of the flange portion near the first annular member. Thereby, the flange portion is cut along the first annular groove, so that the second annular member can be separated from the flange portion.

In the above-described closing member, the first annular member is provided with a second annular groove. The second annular groove surrounds the through hole and is provided in an end portion of the first annular member near the flange portion. Thereby, the first annular member is cut along the second annular groove, so that the first annular member can be separated from the flange portion.

The exhaust structure for the combustion apparatus of the present invention includes the closing member, the exhaust tube, the exhaust pipe, and a rain cap. The closing member is any one of the closing members as described above. The exhaust tube has one end portion and the other end portion, and is connected at the one end portion to a combustion apparatus. The exhaust pipe has the exhaust tube inserted therethrough. The rain cap is connected to the other end portion of the exhaust tube and covers a top of the closing member. The annular portion of the closing member is attached to an outer circumference of the exhaust tube, and the flange portion is held in the tip end portion of the exhaust pipe.

According to the exhaust structure for combustion apparatus of the present invention, the closing member can suppress the outside air from entering through the gap between the exhaust pipe and the exhaust tube on the outside of the building. Also, since the rain cap covers the top of the closing member, moisture such as rain can be suppressed from entering the exhaust pipe from between the through hole of the closing member and the outer circumferential surface of the exhaust tube.

The foregoing and other objects, features, aspects and advantages of the present invention will become more apparent from the following detailed description of the present invention when taken in conjunction with the accompanying drawings.

9 for illustrating the manner in which the second flange member of the closing member in the first modification of one embodiment of the present invention is in contact with the tip end portion of the exhaust pipe.

Figure 11:
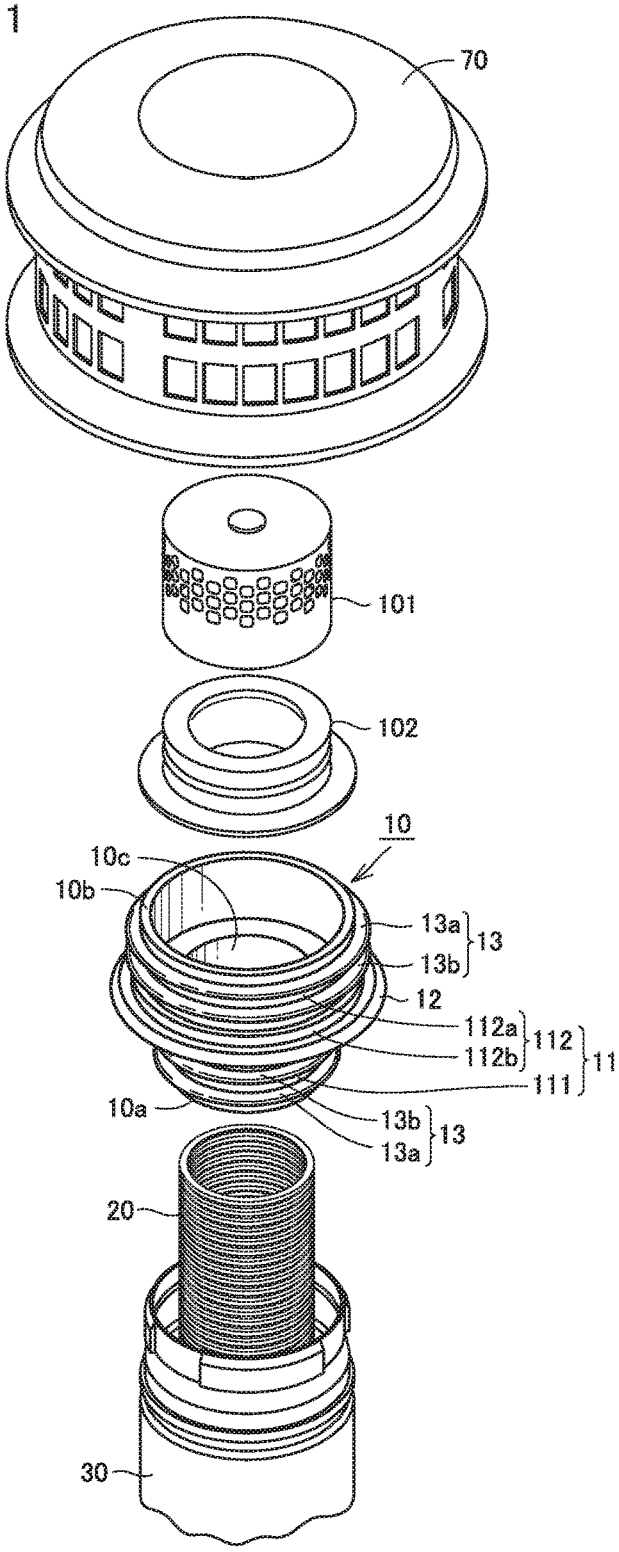

FIG. 11 is an exploded perspective view schematically showing the configuration around a closing member of an exhaust structure for combustion apparatus in the second modification of one embodiment of the present invention.

Figure 12:
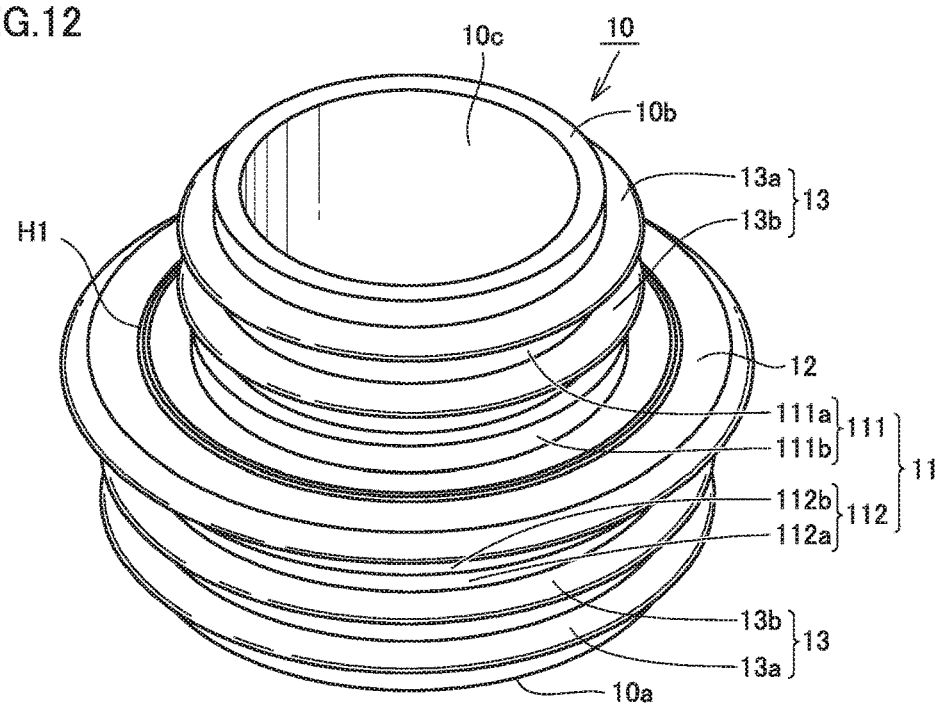

FIG. 12 is a perspective view of the configuration of the closing member in the second modification of one embodiment of the present invention as seen from the first annular member side.

Figure 13:
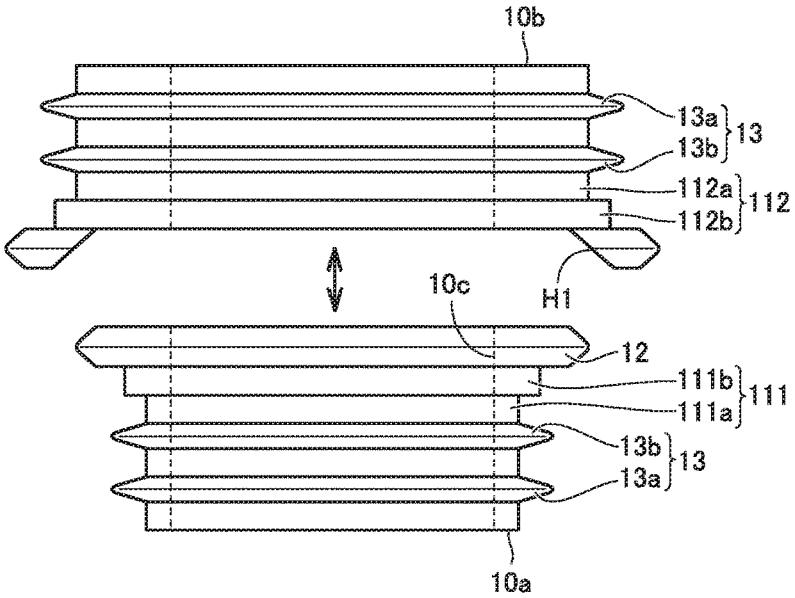

FIG. 13 is a side view showing the manner in which the second annular portion is separated from a flange portion in the closing member in the second modification of one embodiment of the present invention.

Figure 14:
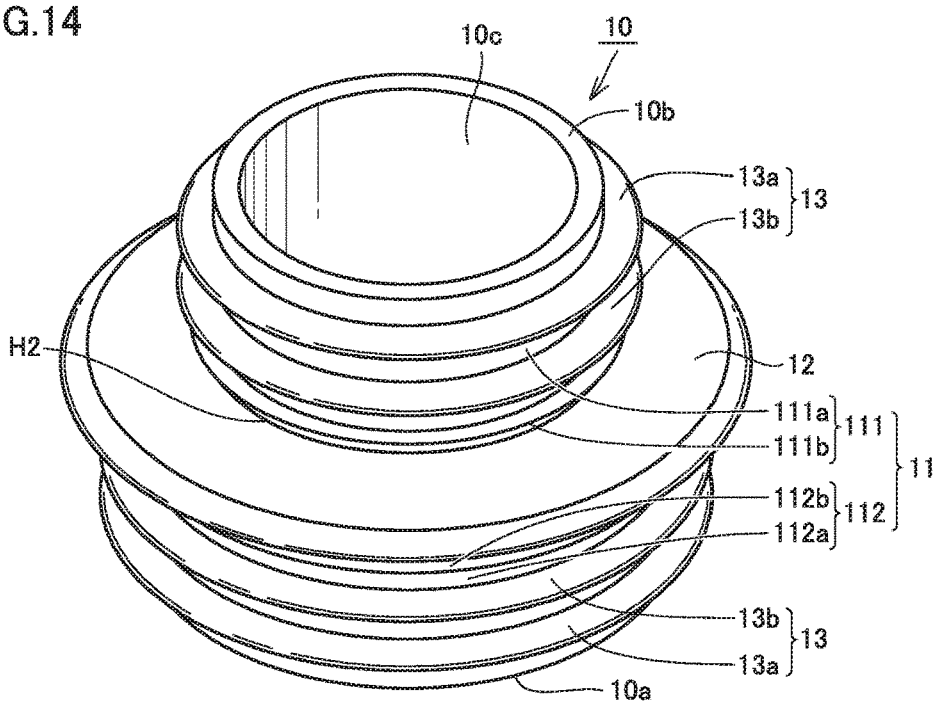

FIG. 14 is a perspective view of the configuration of a closing member in the third modification of one embodiment of the present invention as seen from the first annular member side.

Figure 15:
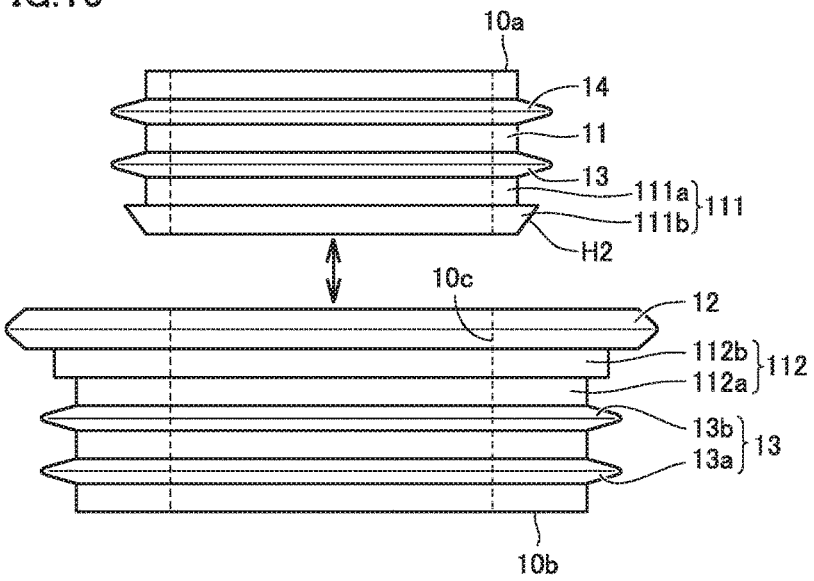

FIG. 15 is a side view showing the manner in which the first annular portion is separated from a flange portion in the closing member in the third modification of one embodiment of the present invention.

Figure 16:
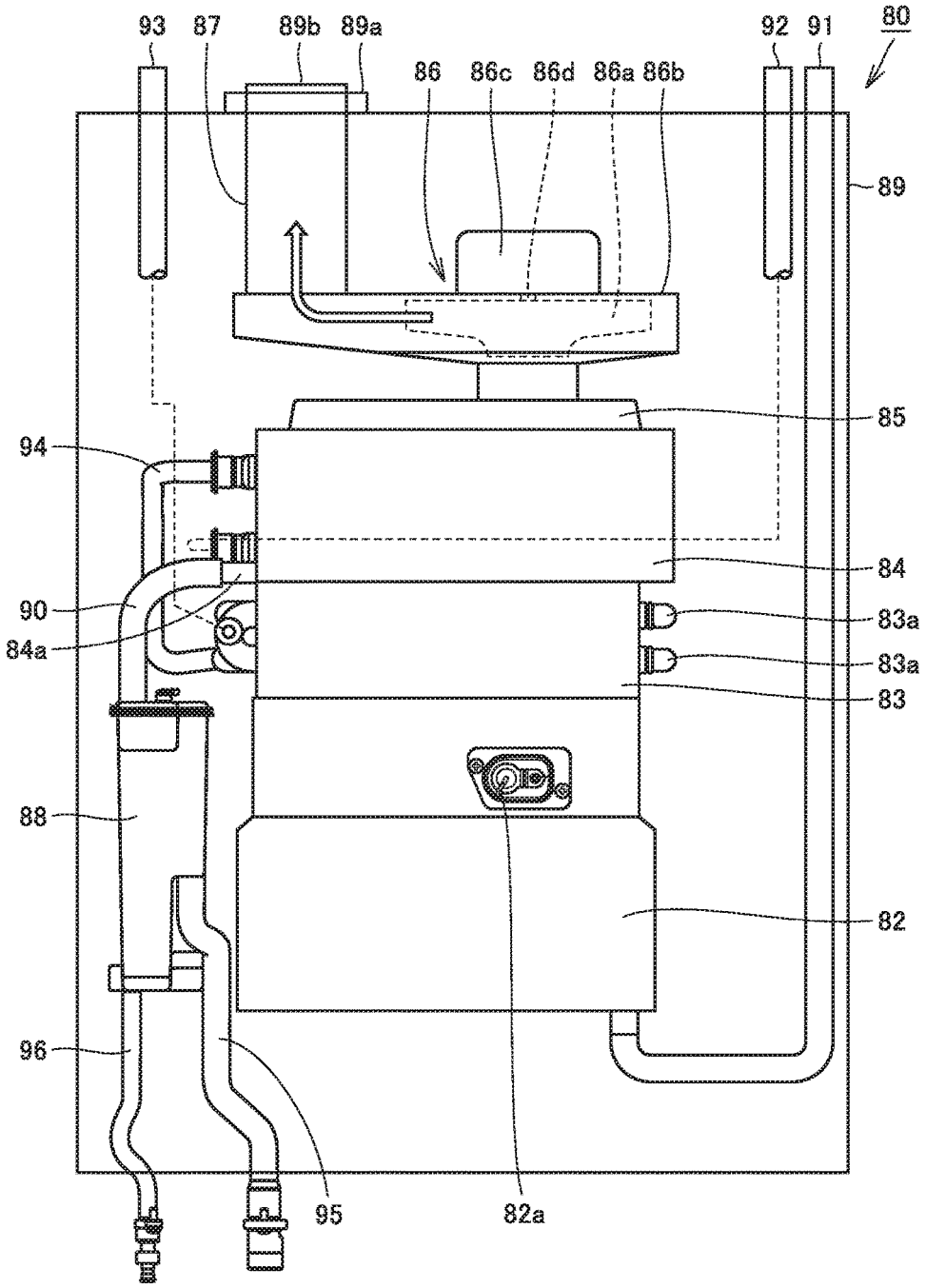

FIG. 16 is a front view schematically showing the configuration of a water heater as an example of a combustion apparatus included in the exhaust structure for combustion apparatus in one embodiment of the present invention.

Figure 17:
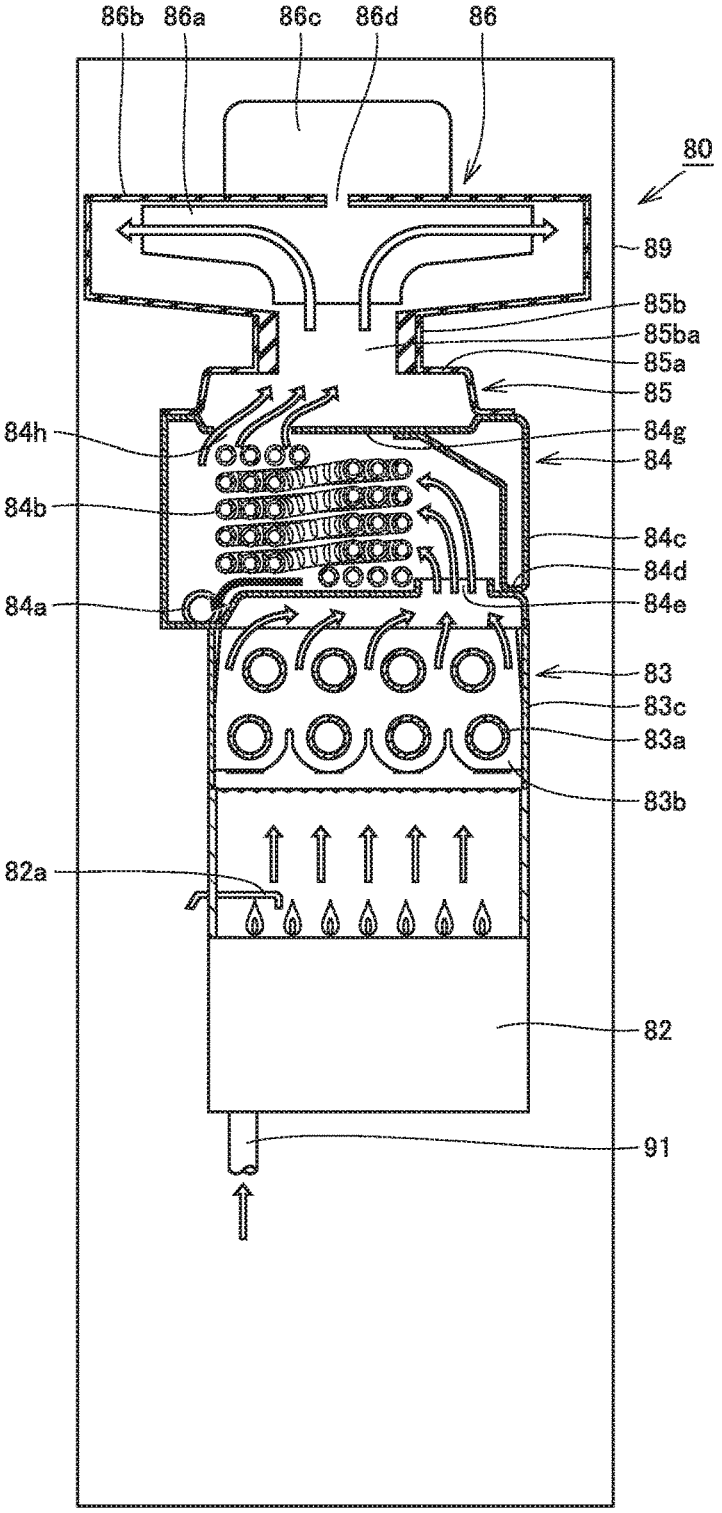

FIG. 17 is a partial cross-sectional side view schematically showing the configuration of the water heater shown in FIG. 16.

DESCRIPTION OF THE PREFERRED EMBODIMENTS

Embodiments of the present invention will be hereinafter described with reference to the drawings.

An exhaust structure for a combustion apparatus in one embodiment of the present invention will be first described.

Figure 1:
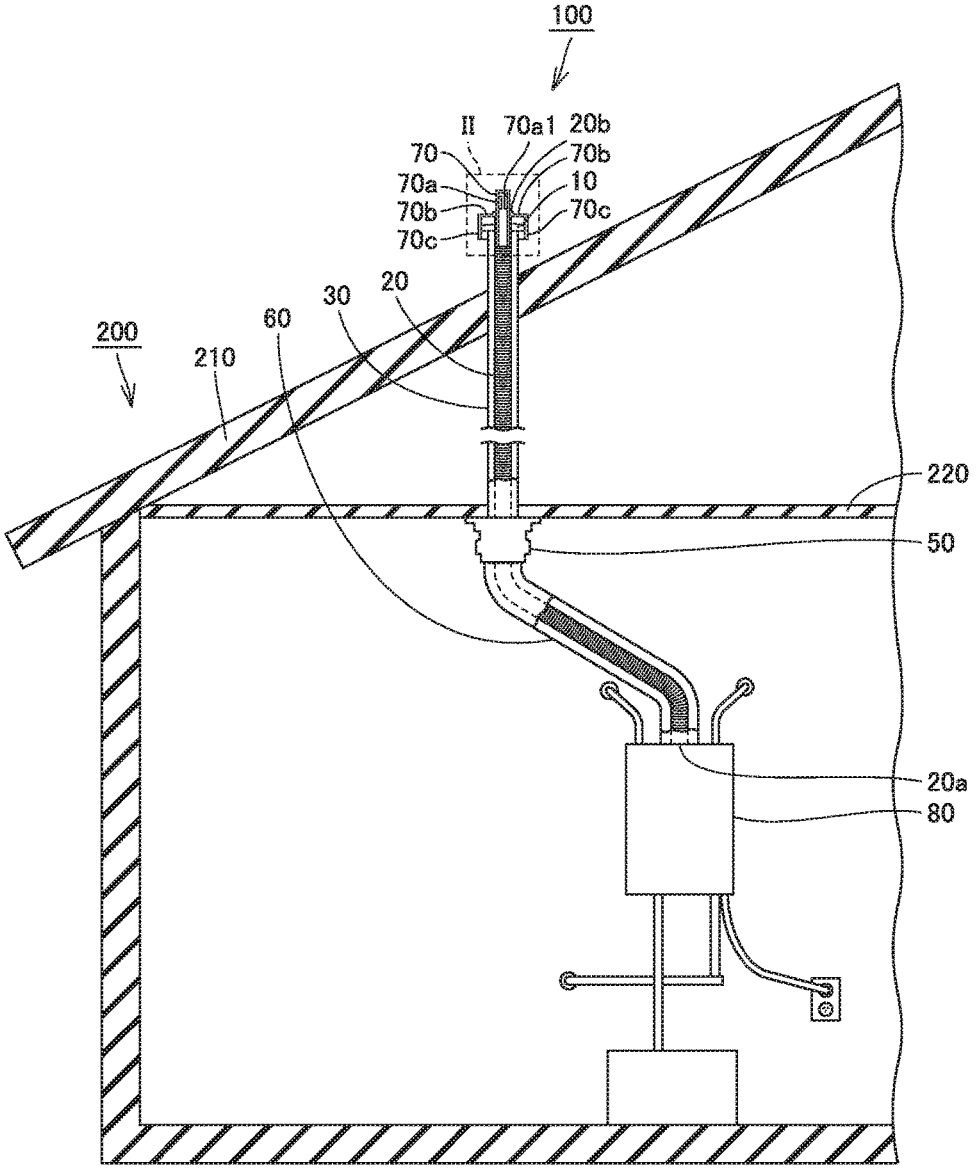
FIG. 1 is a schematic diagram schematically showing the state where an exhaust structure for combustion apparatus in one embodiment of the present invention is installed in a building.

As shown in FIG. 1, an exhaust structure for combustion apparatus 100 in the present embodiment mainly has a combustion apparatus 80, a closing member 10, an exhaust tube (flexible exhaust pipe) 20, an exhaust pipe (B-vent) 30, an exhaust tube fixing member 50, a connection pipe 60, and a rain cap (exhaust terminal) 70. This exhaust structure for combustion apparatus 100 serves to emit combustion gas produced in combustion apparatus 80 to the outside of a building 200.

Combustion apparatus 80 is placed inside building 200. This combustion apparatus 80 serves as a water heater that heats warm water and water, for example, with combustion gas, and may be other combustion apparatuses such as a heating apparatus that warms up the inside of the building with combustion gas. Furthermore, in the case where a water heater is used as combustion apparatus 80, this water heater may be, for example, a water heater of an exhaust suction and combustion type. This water heater may also be a water heater of a latent heat recovery type.

Exhaust tube 20 has one end portion 20*a* and the other end portion 20*b*. Exhaust tube 20 is connected to combustion apparatus 80 at one end portion 20*a*. The other end portion 20*b* of exhaust tube 20 extends to the outside of the building. The inside of exhaust tube 20 is defined as an emission path for the combustion gas emitted from combustion apparatus 80. Thus, the combustion gas produced in combustion apparatus 80 can be guided to the outside of the building through exhaust tube 20.

Exhaust tube 20 is implemented as a flexible pipe such as an accordion pipe, but may be a spiral pipe and the like. This allows exhaust tube 20 to conform also to exhaust pipe 30 having a complicated shape. Furthermore, since an exhaust flows through exhaust tube 20, this exhaust tube 20 can be suitably made of a material having acidic resistance. This is because acidic drainage water may be discharged together with an exhaust in the case where combustion apparatus 80 is a water heater of a latent heat recovery type as in the present embodiment.

Accordingly, exhaust tube 20 can be made of a material having acidic resistance such as phenol resin, epoxy resin, silicone resin, fluorine resin such as polytetrafluoroethylene, unsaturated polyester resin, melamine resin, polycarbonate resin, methacryl styrene (MS) resin, methacryl resin, styrene acrylonitrile copolymer (AS) resin, ABS resin, polyethylene, polypropylene, polystyrene, polyethylene terephthalate (PET), and vinyl chloride resin, for example.

Exhaust pipe 30 is attached to building 200 so as to extend from the inside to the outside, for example, through a roof 210 of building 200. Exhaust pipe 30 may extend from the inside to the outside through a wall. Exhaust pipe 30 is greater in outer diameter than exhaust tube 20. Exhaust pipe 30 has exhaust tube 20 inserted thereinto. Specifically, into this exhaust pipe 30, a part of exhaust tube 20 on the other end portion 20*b* side is inserted. Exhaust pipe 30 is formed of metal, for example. Exhaust pipe 30 has a cross section (a transverse section: a section in a plane that is orthogonal to the axial direction of exhaust pipe 30) having a circular shape, an oval shape or an elliptical shape, for example. Exhaust pipe 30 is connected to exhaust tube fixing member 50 on the lower end side. Furthermore, exhaust pipe 30 does not have to be connected to exhaust tube fixing member 50.

Exhaust tube fixing member 50 serves to fix the position of exhaust tube 20 relative to exhaust pipe 30. Also in the case where exhaust tube fixing member 50 is connected to exhaust pipe 30, exhaust tube fixing member 50 serves to fix exhaust tube 20 to exhaust pipe 30. In the present embodiment, exhaust tube fixing member 50 is attached to exhaust pipe 30 at a position near combustion apparatus 80 relative to closing member 10. Furthermore, exhaust tube fixing member 50 fixes connection pipe 60 to exhaust pipe 30. Furthermore, it is preferable that exhaust tube fixing member 50 is fixed to a ceiling 220 of building 200 in the state where this exhaust tube fixing member 50 is fixed to both of exhaust tube 20 and exhaust pipe 30. It is preferable that exhaust tube fixing member 50 is made of the same material as that of exhaust tube 20.

Figure 2:
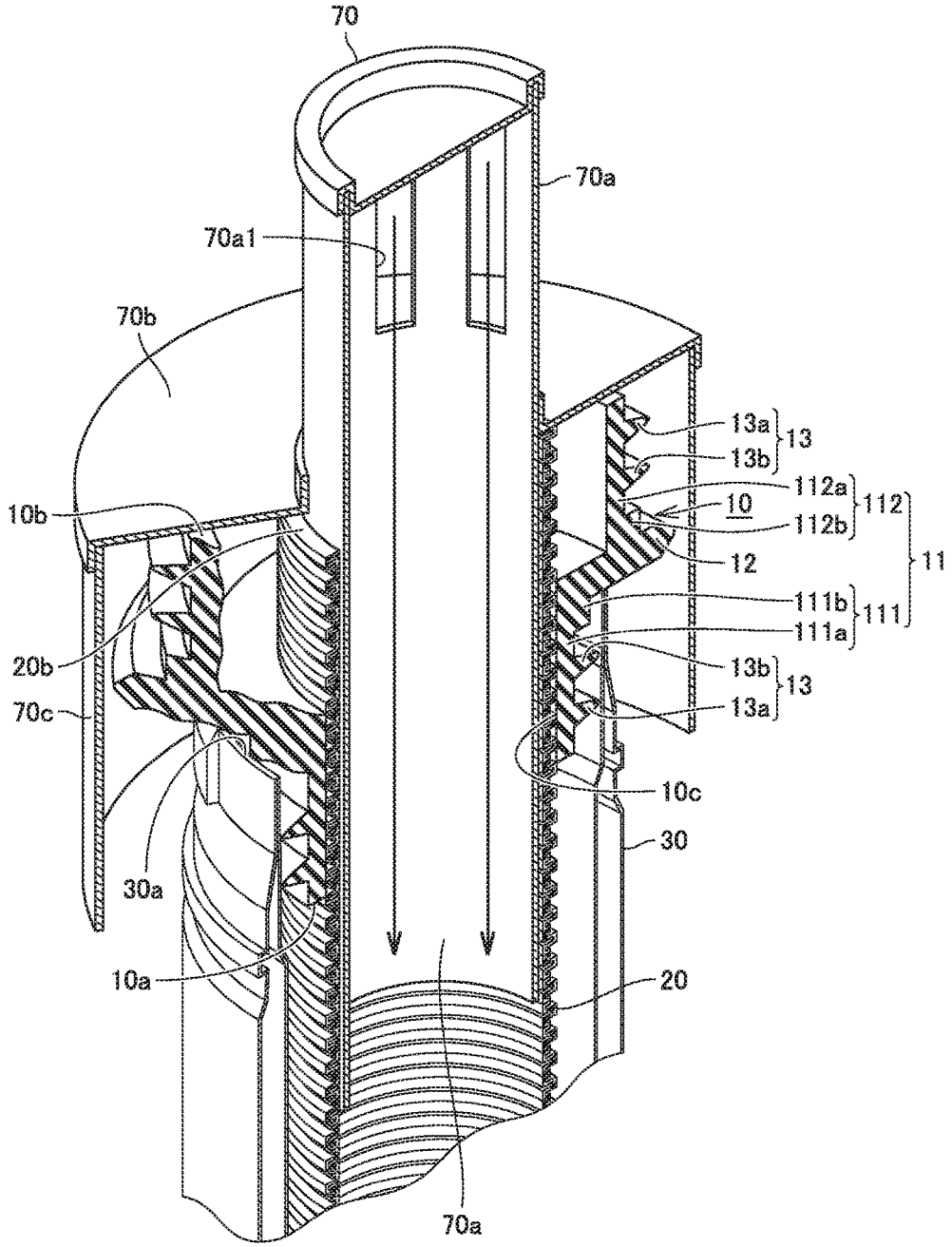
FIG. 2 is a cross-sectional perspective view showing an area corresponding to a region II in FIG. 1 for illustrating the manner in which a closing member included in the exhaust structure for combustion apparatus in one embodiment of the present invention closes a gap between an exhaust pipe and an exhaust tube.

As shown in FIG. 2, rain cap 70 has a discharge portion 70*a*, and cover portions 70*b* and 70*c*. Discharge portion 70*a* is formed, for example, in a cylindrical shape and attached to the other end portion 20*b* of exhaust tube 20. Specifically, discharge portion 70*a* is inserted from the other end portion 20*b* of exhaust tube 20 into exhaust tube 20 so that it is attached to exhaust tube 20. Discharge portion 70*a* is configured to have an outer diameter larger than the inner diameter of exhaust tube 20. Thereby, discharge portion 70*a* is inserted into exhaust tube 20, thereby increasing the inner diameter of exhaust tube 20. Thus, with the force produced when this inner diameter decreases, discharge portion 70*a* is supported by exhaust tube 20.

Discharge portion 70*a* has an upper end portion that is provided with an exhaust port (discharge portion) 70*a*1 through which combustion gas is emitted to the outside (outdoors). This exhaust port 70*a*1 allows the combustion gas guided through exhaust tube 20 to be emitted from rain cap 70 to the outside of building 200.

Cover portions 70*b* and 70*c* of rain cap 70 cover the top and the side, respectively, of closing member 10. Cover portions 70*b* and 70*c* have a ceiling portion 70*b* and a circumferential wall portion 70*c*, respectively. Ceiling portion 70*b* has a circular annular shape extending from the outer circumferential surface of discharge portion 70*a* toward the outer circumferential side. This ceiling portion 70*b* is larger in outer diameter than closing member 10, and covers the top of closing member 10. Circumferential wall portion 70*c* has a cylindrical shape extending from the outer circumferential end of ceiling portion 70*b* in the downward direction. There is a gap existing between the inner circumferential surface of circumferential wall portion 70*c* and the outer circumferential portion of closing member 10. The inner circumferential surface of circumferential wall portion 70*c* may be in contact with the outer circumferential portion of closing member 10. Circumferential wall portion 70*c* covers the side part of closing member 10.

Although an explanation has been given in the above description with regard to the case where discharge portion 70*a* of rain cap 70 is an inner cover attached on the inner circumferential side of exhaust tube 20, this discharge portion 70*a* may be an outer cover attached on the outer circumferential side of exhaust tube 20. Rain cap 70 is made, for example, of such a material as stainless steel.

As shown in FIG. 1, connection pipe 60 serves to cover exhaust tube 20 to protect this exhaust tube 20. Connection pipe 60 is connected to exhaust tube fixing member 50 and combustion apparatus 80. Connection pipe 60 is larger in outer diameter than exhaust tube 20. A part of exhaust tube 20 on the one end portion 20*a* side is inserted into connection pipe 60.

It is to be noted that connection pipe 60 is implemented as a flexible pipe such as an accordion pipe, but may be a spiral pipe. Connection pipe 60 has flexibility, thereby allowing this connection pipe 60 to readily conform to the shape of exhaust tube 20. Furthermore, connection pipe 60 and combustion apparatus 80 can readily be connected.

Furthermore, connection pipe 60 may be a pipe made of aluminum, for example. In this case, since connection pipe 60 can be reduced in weight, the load on exhaust tube fixing member 50 supporting connection pipe 60 can be decreased. Also, since connection pipe 60 has a certain degree of hardness, deformation of connection pipe 60 caused by its self-weight can be suppressed. Furthermore, since the pipe made of aluminum can be relatively readily processed, for example, cut and the like, it can readily be adapted to the length of exhaust tube 20, for example.

As shown in FIGS. 1 and 2, closing member 10 is supported by exhaust pipe 30 extending from the inside to the outside of building 200. On its inner circumferential side, closing member 10 supports exhaust tube 20 that is inserted into exhaust pipe 30. Closing member 10 serves to close the gap between exhaust pipe 30 and exhaust tube 20 on the outside of the building. Furthermore, closing member 10 serves to hold exhaust tube 20, which is connected to combustion apparatus 80, in exhaust pipe 30. It is preferable that closing member 10 is made of a material having acidic resistance. The material of closing member 10 can be made of a material having acidic resistance such as phenol resin, epoxy resin, silicone resin, fluorine resin such as polytetrafluoroethylene, unsaturated polyester resin, melamine resin, polycarbonate resin, methacryl styrene (MS) resin, methacryl resin, styrene acrylonitrile copolymer (AS) resin, ABS resin, polyethylene, polypropylene, polystyrene, polyethylene terephthalate (PET), and vinyl chloride resin, for example.

Figure 3:
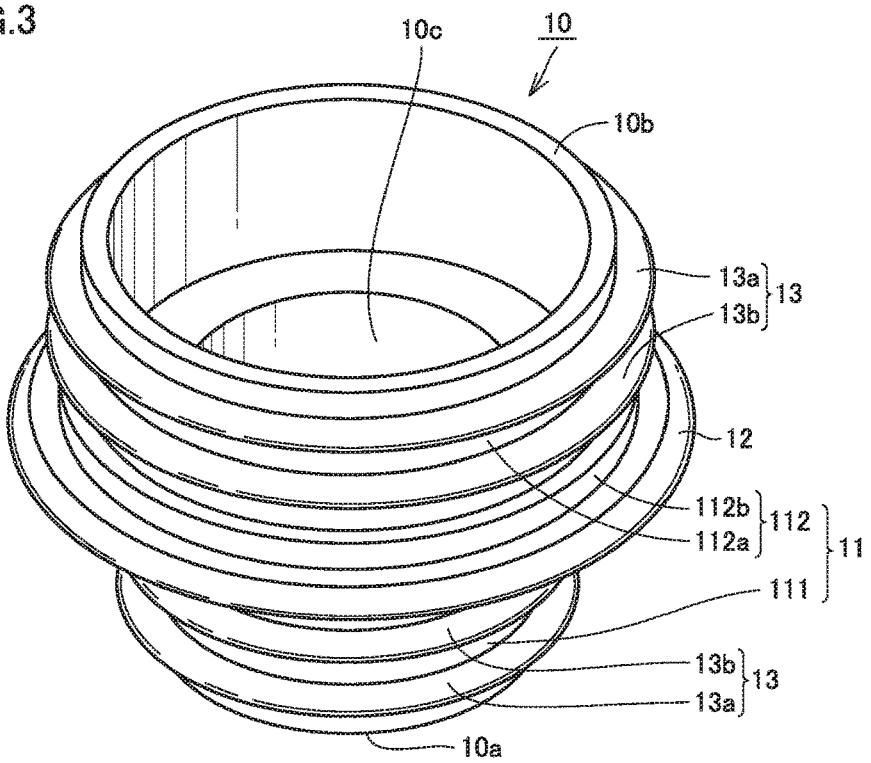
FIG. 3 is a perspective view of the configuration of the closing member shown in FIG. 2 as seen from the second annular member side.

Then, the configuration of the above-described closing member 10 will be hereinafter described in greater detail with reference to FIGS. 2 to 7. As shown in FIGS. 2 and 3, closing member 10 has a first end portion l0*a* and a second end portion 10*b* that are located opposite to each other, and a through hole 10*c* passing therethrough from first end portion l0*a* to second end portion 10*b*. Closing member 10 has an annular shape surrounding through hole 10*c*. Closing member 10 has an annular portion 11, a flange portion 12, and an outer circumferential side protrusion 13. Each of annular portion 11, flange portion 12 and outer circumferential side protrusion 13 is formed, for example, in a circular shape, an oval shape, an elliptical shape or the like in accordance with the cross-sectional shape of exhaust pipe 30. Annular portion 11 has first end portion 10*a*, second end portion 10*b*, and through hole 10*c*. In at least a part of through hole 10*c*, annular portion 11 is in contact with the outer circumferential surface of exhaust tube 20. Annular portion 11 is attached to the outer circumference of exhaust tube 20.

Figure 4:
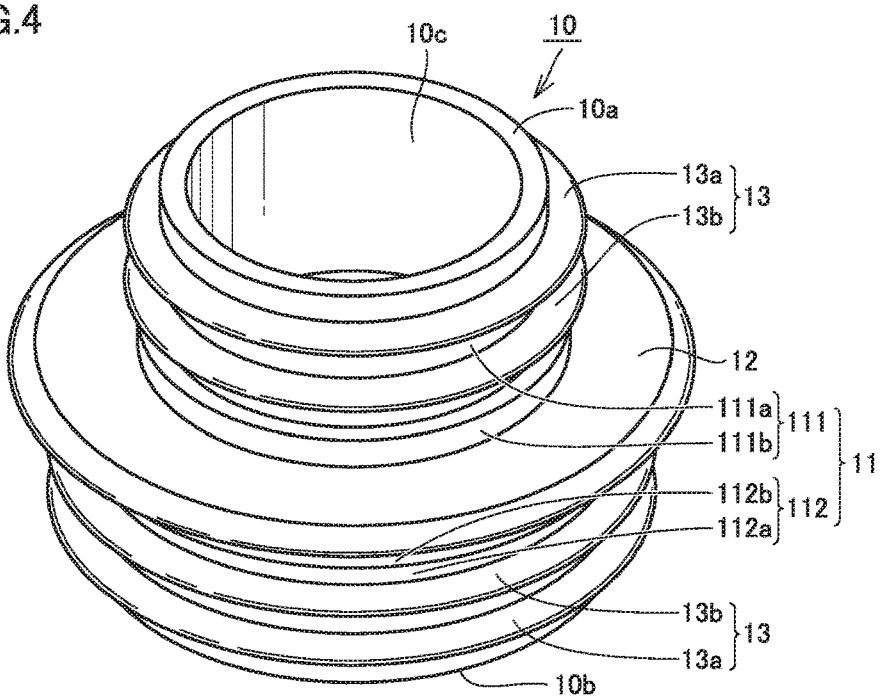
FIG. 4 is a perspective view of the configuration of the closing member shown in FIG. 2 as seen from the first annular member side.

As shown in FIGS. 3 and 4, annular portion 11 includes a first annular member 111 and a second annular member 112 that is larger in outer diameter than first annular member 111. First annular member 111 is used for closing the gap between exhaust tube 20 and exhaust pipe 30 that has a relatively smaller opening diameter (for example, 3 inches). Second annular member 112 is used for closing the gap between exhaust tube 20 and exhaust pipe 30 that has a relatively larger opening diameter (for example, 4 inches).

First annular member 111 has a first main body portion 111*a* and a first reinforcing portion 111*b*. First main body portion 111*a* and first reinforcing portion 111*b* each are formed in an annular shape and joined to each other. First reinforcing portion 111*b* is larger in outer diameter than first main body portion 111*a*. Second annular member 112 has a second main body portion 112*a* and a second reinforcing portion 112*b*. Second main body portion 112*a* and second reinforcing portion 112*b* each are formed in an annular shape and joined to each other. Second reinforcing portion 112*b* is larger in outer diameter than second main body portion 112*a*. First reinforcing portion 111*b* and second reinforcing portion 112*b* each serve to reinforce flange portion 12. First reinforcing portion 111*b* and second reinforcing portion 112*b* each are arranged at a position near flange portion 12. First annular member 111 and second annular member 112 are arranged on both sides of flange portion 12. First annular member 111 is arranged on the first side of flange portion 12 and second annular member 112 is arranged on the second side of flange portion 12 that is opposite to the first side. In other words, first annular member 111 is arranged at a position near first end portion 10*a* relative to flange portion 12 while second annular member 112 is arranged at a position near second end portion 10*b* relative to flange portion 12.

Flange portion 12 is formed in an annular shape. Flange portion 12 extends from the outer circumferential surface of annular portion 11 toward the outer side. Flange portion 12 protrudes toward the outer circumferential side such that its entire circumference extends beyond the outer circumferential surface of annular portion 11. Flange portion 12 protrudes beyond outer circumferential side protrusion 13 toward the outer circumferential side of annular portion 11.

Outer circumferential side protrusion 13 is formed in an annular shape. Outer circumferential side protrusion 13 protrudes toward the outer circumferential side such that its entire circumference extends beyond the outer circumferential surface of annular portion 11. In the present embodiment, outer circumferential side protrusion 13 is provided in each of first annular member 111 and second annular member 112. Outer circumferential side protrusion 13 may be formed, for example, of a plurality of annular protruding portions 13*a* and 13*b* protruding toward the outer circumferential side beyond the outer circumferential surface of annular portion 11. Specifically, each of first annular member 111 and second annular member 112 is provided with a plurality of protruding portions 13*a* and 13*b*. Outer circumferential side protrusion 13 (each of the plurality of protruding portions 13*a* and 13*b*) is formed to be reduced in width toward its outer circumferential end. The outer circumferential end of outer circumferential side protrusion 13 (each of the plurality of protruding portions 13*a* and 13*b*) may be sharpened or may not be sharpened but be rounded.

Figure 5:
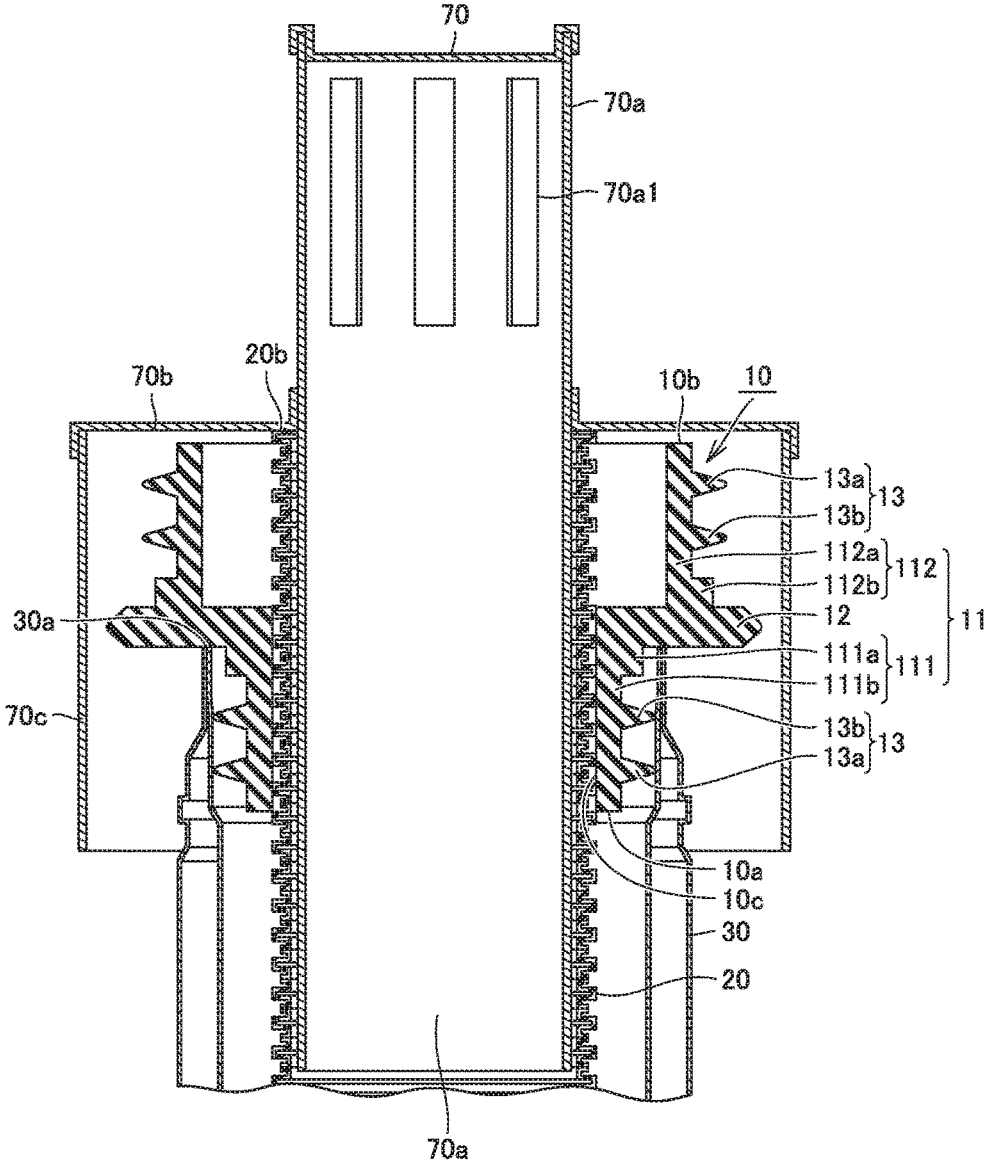
FIG. 5 is a cross-sectional view corresponding to the cross-sectional perspective view shown in FIG. 2.

As shown in FIG. 5, flange portion 12 is larger in outer diameter than exhaust pipe 30. Flange portion 12 is in contact with tip end portion 30*a* of exhaust pipe 30 located on the outside of the building so as to block the space between exhaust pipe 30 and exhaust tube 20. Flange portion 12 is formed to protrude toward the outer side such that its entire circumference extends beyond the outer circumferential surface of tip end portion 30*a* of exhaust pipe 30. Thereby, the gap between tip end portion 30*a* of exhaust pipe 30 and exhaust tube 20 can be closed. Flange portion 12 has an outer diameter larger than the relatively smaller (for example, 3 inches) outer diameter of exhaust pipe 30 and an outer diameter larger than the relatively larger (for example, 4 inches) outer diameter of exhaust pipe 30.

Annular portion 11 of closing member 10 is configured such that it is fitted on the outer circumference of exhaust tube 20, thereby causing the inner circumferential surface of annular portion 11 to press the outer circumferential surface of exhaust tube 20. Specifically, the inner diameter of annular portion 11 measured before this annular portion 11 is fitted on the outer circumference of exhaust tube 20 is set to have a size equal to or less than the outer diameter of exhaust tube 20. Furthermore, a portion corresponding to the inner circumferential surface of annular portion 11 is made of an elastic material as described above.

Thereby, in the state where the portion corresponding to the inner circumferential surface of closing member 10 is elastically deformed so as to increase the inner diameter of annular portion 11, closing member 10 is fitted on the outer circumference of exhaust tube 20. After annular portion 11 is fitted on, the portion corresponding to the inner circumferential surface of annular portion 11 can be restored. Such restoration allows the inner circumferential surface of annular portion 11 to press the outer circumferential surface of exhaust tube 20 in the state where annular portion 11 is fitted on the outer circumference of exhaust tube 20.

Furthermore, closing member 10 is configured such that it is fitted in exhaust pipe 30, thereby causing outer circumferential side protrusion 13 (each of the plurality of protruding portions 13*a* and 13*b*) to press the inner circumferential surface of exhaust pipe 30. Specifically, first annular member 111 has an outer diameter smaller than the inner diameter of exhaust pipe 30. In this state where first annular member 111 is inserted into exhaust pipe 30, outer circumferential side protrusion 13 (each of the plurality of protruding portions 13*a* and 13*b*) provided in first annular member 111 presses the inner circumferential surface of exhaust pipe 30. Before closing member 10 is fitted in exhaust pipe 30, the outer diameter of outer circumferential side protrusion 13 (each of the plurality of protruding portions 13*a* and 13*b*) provided in first annular member 111 is sized to be equal to or greater than the inner diameter of exhaust pipe 30. Furthermore, outer circumferential side protrusion 13 (each of the plurality of protruding portions 13*a* and 13*b*) provided in first annular member 111 is made of an elastic material as described above.

Thereby, in the state where outer circumferential side protrusion 13 (each of the plurality of protruding portions 13*a* and 13*b*) provided in first annular member 111 is elastically deformed so as to be reduced in its outer diameter, first annular member 111 is inserted into exhaust pipe 30. After this insertion, outer circumferential side protrusion 13 (each of the plurality of protruding portions 13*a* and 13*b*) can be restored. Such restoration allows outer circumferential side protrusion 13 (each of the plurality of protruding portions 13*a* and 13*b*) to press the inner circumferential surface of exhaust pipe 30 in the state where closing member 10 is fitted in the inner circumference of exhaust pipe 30.

Although an explanation has been given in the above description with regard to the case where closing member 10 is used for exhaust pipe 30 with a relatively smaller diameter (for example, 3 inches), closing member 10 can also be used for exhaust pipe 30 with a relatively larger diameter (for example, 4 inches). Then, an explanation will be hereinafter given with regard to the case where closing member 10 is used for exhaust pipe 30 with a relatively larger diameter (for example, 4 inches).

Figure 6:
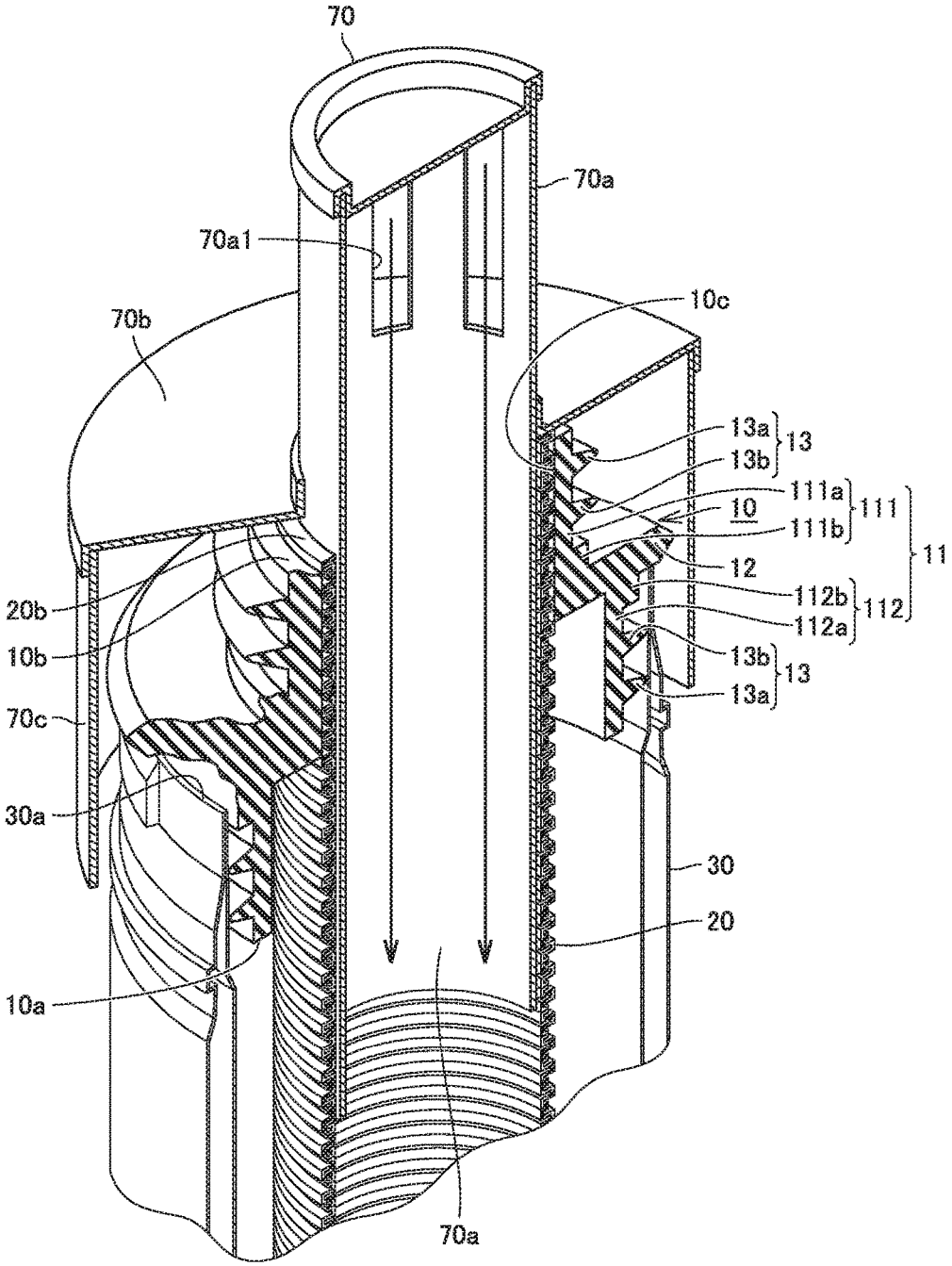
FIG. 6 is a cross-sectional perspective view illustrating the state where the positions of the first annular member and the second annular member of the closing member shown in FIG. 2 are reversed.
Figure 7:
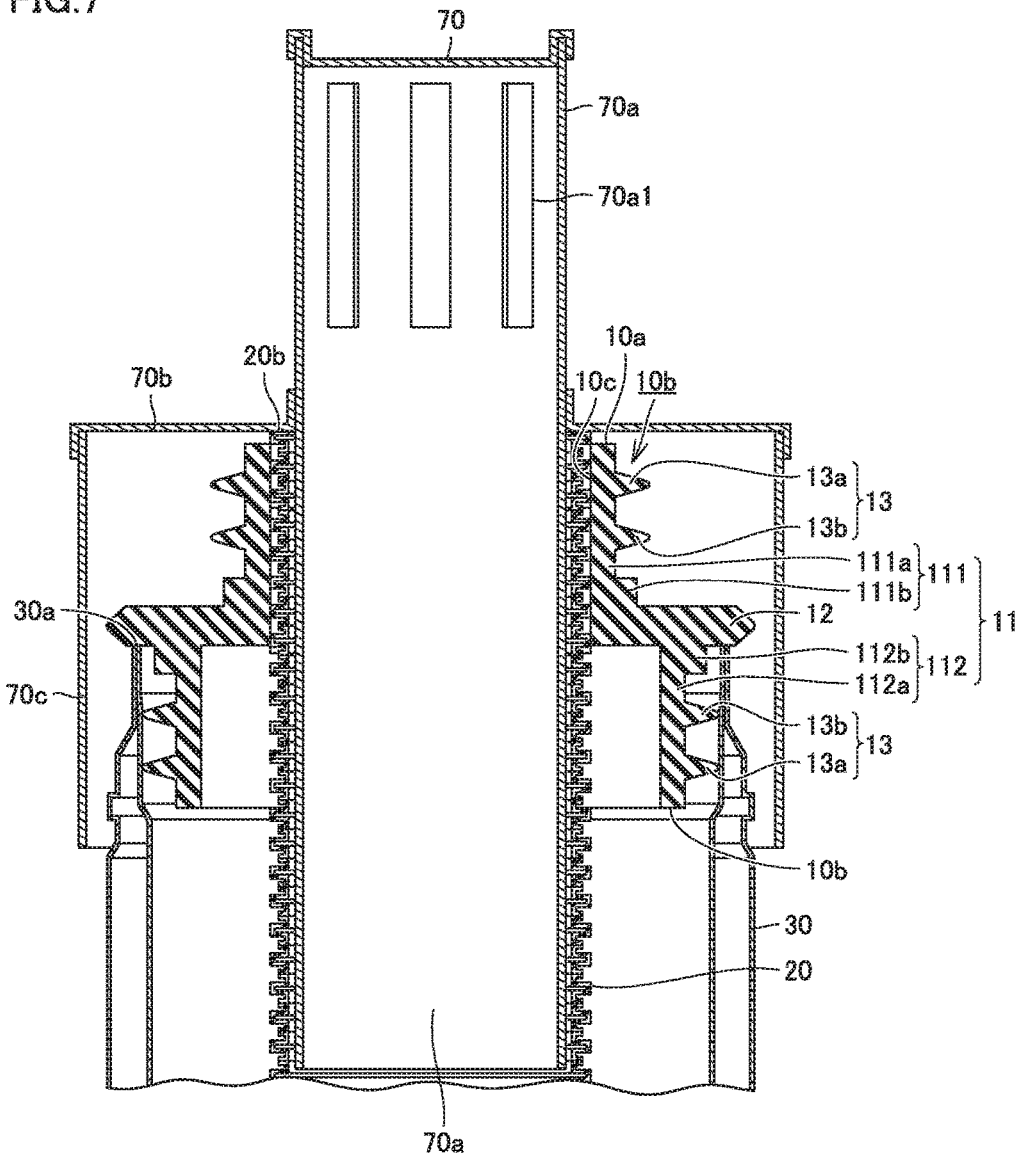
FIG. 7 is a cross-sectional view corresponding to the cross-sectional perspective view shown in FIG. 6.

As shown in FIGS. 6 and 7, second annular member 112 is inserted into exhaust pipe 30. Namely, the positions of first annular member 111 and second annular member 112 are reversed, as compared with the state shown in FIG. 5. Second annular member 112 has an outer diameter smaller than the inner diameter of exhaust pipe 30. In the state where second annular member 112 is inserted into exhaust pipe 30, outer circumferential side protrusion 13 (each of the plurality of protruding portions 13*a* and 13*b*) provided in second annular member 112 presses the inner circumferential surface of exhaust pipe 30. Before closing member 10 is fitted in exhaust pipe 30, the outer diameter of outer circumferential side protrusion 13 (each of the plurality of protruding portions 13*a* and 13*b*) provided in second annular member 112 is sized to be equal to or greater than the inner diameter of exhaust pipe 30. Furthermore, outer circumferential side protrusion 13 (each of the plurality of protruding portions 13*a* and 13*b*) provided in second annular member 112 is made of an elastic material as described above.

Thereby, in the state where outer circumferential side protrusion 13 (each of the plurality of protruding portions 13*a* and 13*b*) provided in second annular member 112 is elastically deformed so as to be reduced in its outer diameter, second annular member 112 is inserted into exhaust pipe 30. After this insertion, outer circumferential side protrusion 13 (each of the plurality of protruding portions 13*a* and 13*b*) can be restored. Such restoration allows outer circumferential side protrusion 13 (each of the plurality of protruding portions 13*a* and 13*b*) to press the inner circumferential surface of exhaust pipe 30 in the state where closing member 10 is fitted in the inner circumference of exhaust pipe 30.

As described above, first annular member 111 is used for exhaust pipe 30 with a relatively smaller diameter (for example, 3 inches) and second annular member 112 is used for exhaust pipe 30 with a relatively larger diameter (for example, 4 inches), so that one closing member 10 can be adapted for various exhaust pipes 30 with different diameters.

Then, the first modification of the present embodiment will be hereinafter described with reference to FIGS. 8 to 10. Rain cap 70 is not shown in FIGS. 9 and 10 for ease of illustration. Although an explanation has been given in the above description with regard to the case where first annular member 111 and second annular member 112 are arranged on both sides of flange portion 12, each of first annular member 111 and second annular member 112 may be arranged on one side of flange portion 12.

Figure 8:
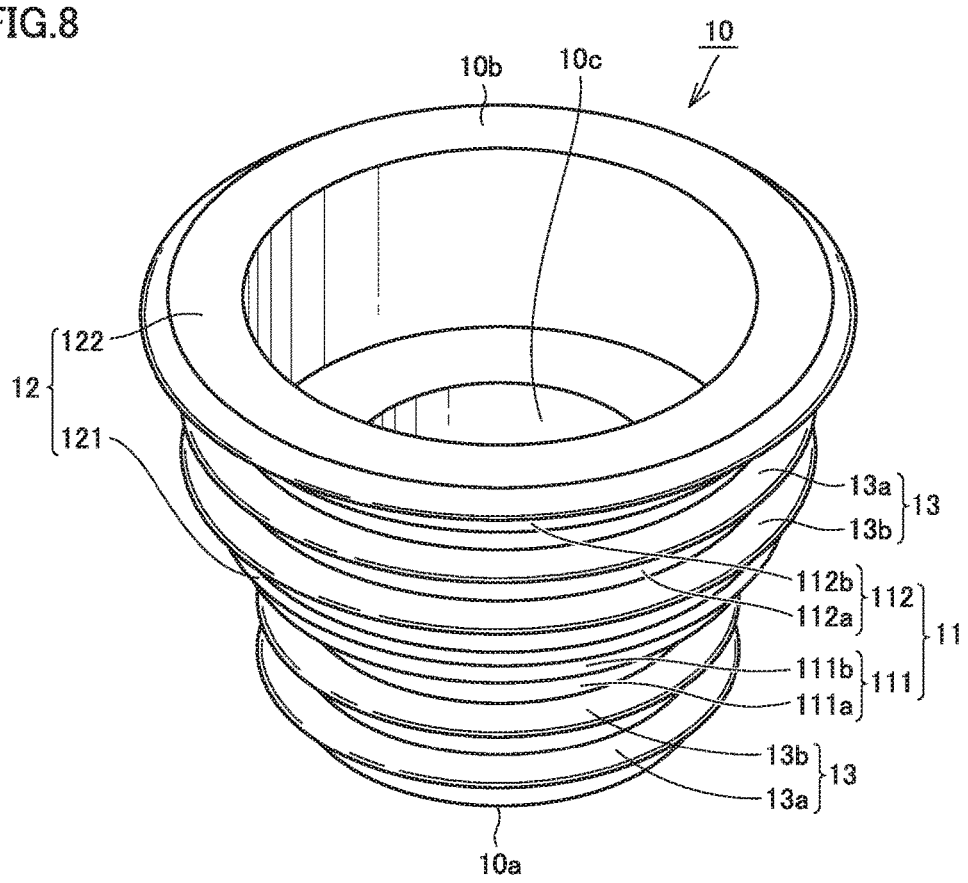
FIG. 8 is a perspective view showing the configuration of a closing member in the first modification of one embodiment of the present invention.

In the first modification of the present embodiment, as shown in FIG. 8, each of first annular member 111 and second annular member 112 is arranged on one side of flange portion 12. Specifically, flange portion 12 includes a first flange member 121 and a second flange member 122 that is larger in outer diameter than first flange member 121. First flange member 121 has an outer diameter larger than the relatively smaller (for example, 3 inches) outer diameter of exhaust pipe 30. First flange member 121 is formed to protrude toward the outer side such that its entire circumference extends beyond the outer circumferential surface of tip end portion 30*a* of exhaust pipe 30 with a relatively smaller diameter (for example, 3 inches). Second flange member 122 has an outer diameter larger than the relatively larger (for example, 4 inches) outer diameter of exhaust pipe 30. Second flange member 122 is formed to protrude toward the outer side such that its entire circumference extends beyond the outer circumferential surface of tip end portion 30*a* of exhaust pipe 30 with a relatively larger diameter (for example, 4 inches).

First annular member 111 is arranged on the first side of first flange member 121 and second annular member 112 is arranged on the second side of first flange member 121 that is opposite to the first side. First annular member 111 is arranged near first end portion l0*a* relative to first flange member 121, and second annular member 112 is arranged near first end portion l0*a* relative to second flange member 122. In other words, first annular member 111 and second annular member 112 are arranged on both sides of first flange member 121. Also, first flange member 121 is arranged on the first side of second annular member 112 and second flange member 122 is arranged on the second side of second annular member 112 that is opposite to the first side of second annular member 112. In other words, first flange member 121 and second flange member 122 are arranged on both sides of second annular member 112.

Figure 9:
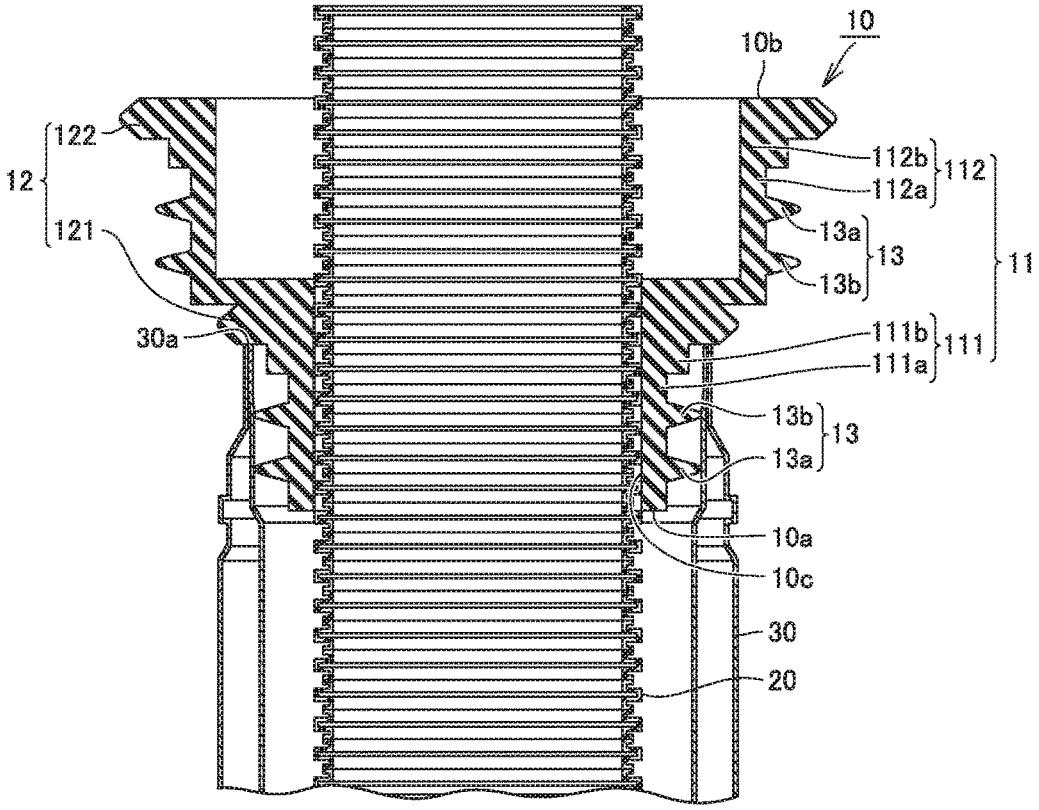
FIG. 9 is a cross-sectional view corresponding to the cross section shown in FIG. 5 for illustrating the manner in which the first flange member of the closing member in the first modification of one embodiment of the present invention is in contact with a tip end portion of the exhaust pipe.

In the case where closing member 10 is used for exhaust pipe 30 with a relatively smaller diameter (for example, 3 inches), as shown in FIG. 9, in the state where exhaust tube 20 is inserted into through hole 10*c* of closing member 10 and supported therein, first annular member 111 is inserted into exhaust pipe 30 and first flange member 121 comes in contact with tip end portion 30*a* of exhaust pipe 30. Thereby, the gap between tip end portion 30*a* of exhaust pipe 30 and exhaust tube 20 can be closed.

Figure 10:
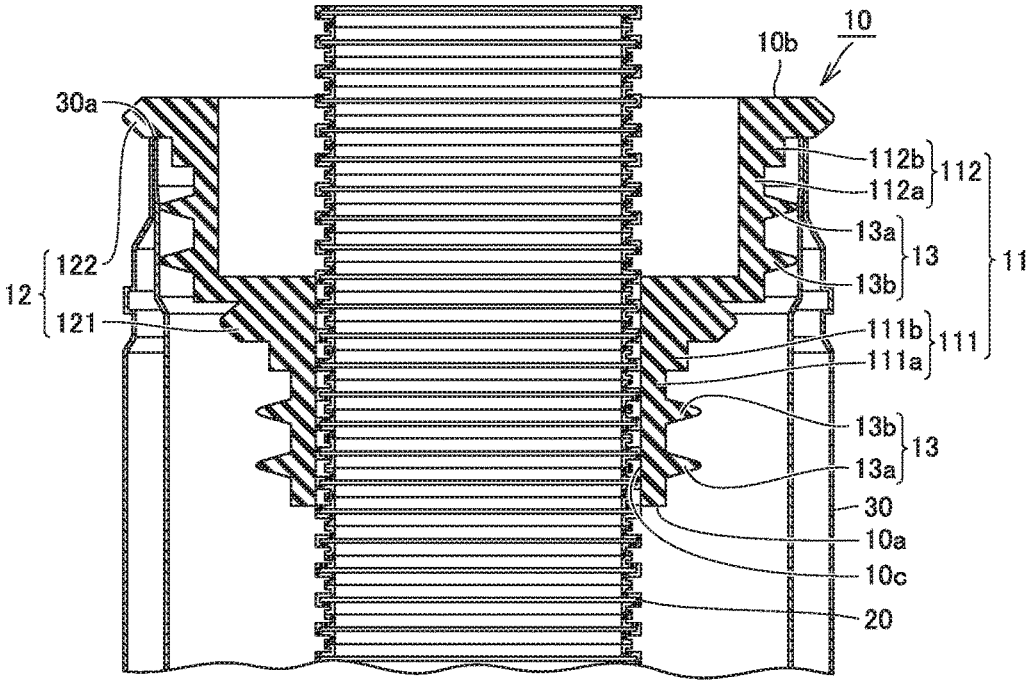
FIG. 10 is a cross-sectional view corresponding to the cross section shown in FIG.

Also in the case where closing member 10 is used for exhaust pipe 30 with a relatively larger diameter (for example, 4 inches), as shown in FIG. 10, in the state where exhaust tube 20 is inserted into through hole 10*c* of closing member 10 and supported therein, both of first annular member 111 and second annular member 112 are inserted into exhaust pipe 30, and second flange member 122 comes in contact with tip end portion 30*a* of exhaust pipe 30. Thereby, the gap between tip end portion 30*a* of exhaust pipe 30 and exhaust tube 20 can be closed.

Then, a method of installing an exhaust structure for combustion apparatus 100 in the present embodiment will be hereinafter described with reference to FIGS. 1 and 2.

As shown in FIG. 1, one end portion 20*a* of exhaust tube 20 is connected to combustion apparatus 80. The other end portion 20*b* of exhaust tube 20 is inserted into exhaust pipe 30 from the lower end of exhaust pipe 30. As shown in FIG. 2, the other end portion 20*b* of exhaust tube 20 is pulled out from tip end portion 30*a* of exhaust pipe 30. In the state where the other end portion 20*b* of exhaust tube 20 is pulled out from tip end portion 30*a* of exhaust pipe 30, closing member 10 is attached to the outer circumference of exhaust tube 20. Closing member 10 is attached to exhaust tube 20 by inserting exhaust tube 20 through the other end portion 20*b* into through hole 10*c* of closing member 10 and attaching the inner circumferential surface of closing member 10 to the outer circumferential surface of exhaust tube 20.

First annular member 111 of closing member 10 attached to the outer circumference of exhaust tube 20 is inserted into exhaust pipe 30. Then, flange portion 12 of closing member 10 comes in contact with tip end portion 30*a* of exhaust pipe 30 from above, thereby causing flange portion 12 to be held in tip end portion 30*a* of exhaust pipe 30. Then, rain cap 70 is attached to exhaust tube 20. Specifically, discharge portion 70*a* of rain cap 70 is inserted from the other end portion 20*b* of exhaust tube 20 into exhaust tube 20. Thereby, exhaust structure for combustion apparatus 100 in the present embodiment is installed in a building 200.

Then, the second modification of the present embodiment will be hereinafter described with reference to FIGS. 11 and 12.

Exhaust structure for combustion apparatus 100 in the second modification of the present embodiment is different in shape of rain cap 70 from the above-described exhaust structure for combustion apparatus 100. Furthermore, exhaust structure for combustion apparatus 100 in the second modification of the present embodiment is different from the above-described exhaust structure for combustion apparatus 100 in that it has an exhaust straightening member (a diffuser) 101 and a holding member (a diffuser gasket) 102.

Rain cap 70 is connected to exhaust pipe 30. Rain cap 70 may be an outer cover attached on the outer circumferential side of exhaust pipe 30.

Exhaust straightening member 101 is fitted, for example, on the outer circumferential surface of holding member 102. Holding member 102 serves to attach exhaust straightening member 101 to the other end portion 20*b* of exhaust tube 20. Holding member 102 is fitted on exhaust tube 20, and exhaust straightening member 101 is fitted on holding member 102, so that exhaust straightening member 101 is attached to the other end portion 20*b* of exhaust tube 20.

As shown in FIG. 12, in closing member 10 in the second modification of the present embodiment, flange portion 12 is provided with a first annular groove H1. First annular groove H1 surrounds through hole 10*c*, and is provided in the end face of flange portion 12 near first annular member 111. First annular groove H1 is formed in a V-shape.

As shown in FIG. 13, in closing member 10 in the second modification of the present embodiment, flange portion 12 can be cut along first annular groove H1. Thereby, closing member 10 can be divided. Specifically, second annular member 112 can be separated from flange portion 12.

According to the method of installing exhaust structure for combustion apparatus 100 in the second modification of the present embodiment, when closing member 10 is attached to exhaust tube 20, rain cap 70 is first removed from the already-placed exhaust pipe 30. Then, closing member 10 in the second modification of the present embodiment is attached. In this case, rain cap 70 may not be able to be exchanged with another rain cap 70 having a larger size in accordance with the size of closing member 10.

Even when rain cap 70 cannot be exchanged in this way, closing member 10 in the second modification of the present embodiment can be reduced in size by cutting flange portion 12 along first annular groove H1 to thereby divide closing member 10.

Then, the third modification of the present embodiment will be hereinafter described with reference to FIGS. 14 and 15.

Although the annular groove is provided in flange portion 12 in the above-described second modification of the present embodiment, the annular groove may be provided in first annular member 111.

As shown in FIG. 14, in closing member 10 in the third modification of the present embodiment, first annular member 111 is provided with a second annular groove H2. Second annular groove H2 surrounds through hole 10*c*, and is provided in the end face of first annular member 111 near flange portion 12. Second annular groove H2 is formed so as to be inclined toward flange portion 12. Specifically, second annular groove H2 has an inclined surface with a diameter that is continuously reduced toward flange portion 12.

As shown in FIG. 15, in closing member 10 in the third modification of the present embodiment, first annular member 111 can be cut along second annular groove H2. Thereby, closing member 10 can be divided. Specifically, first annular member 111 can be separated from flange portion 12.

In the third modification of the present embodiment, even when rain cap 70 cannot be replaced as described above, first annular member 111 is cut along second annular groove H2 to separate closing member 10, so that closing member 10 can be reduced in size.

Then, the configuration of combustion apparatus 80 used in exhaust structure for combustion apparatus 100 as described above will be hereinafter described with reference to FIGS. 16 and 17.

Combustion apparatus 80 used in exhaust structure for combustion apparatus 100 described above may be a water heater of a latent heat recovery type, for example, adapted to an exhaust suction and combustion system, as described above.

As shown in FIGS. 16 and 17, combustion apparatus 80 mainly has a burner 82, a primary heat exchanger 83, a secondary heat exchanger 84, an exhaust box 85, a fan 86, a connection pipe 87, a drainage water tank 88, a housing 89, and pipes 90 to 96.

Burner 82 serves to produce combustion gas by burning fuel gas. A gas supply pipe 91 is connected to burner 82. This gas supply pipe 91 serves to supply fuel gas to burner 82. A gas valve (not shown) implemented, for example, by an electromagnetic valve is attached to this gas supply pipe 91.

A spark plug 82*a* is disposed above burner 82. This spark plug 82*a* serves to ignite an air fuel mixture injected from burner 82 to thereby produce a flame, by generating sparks between the plug and a target (not shown) provided in burner 82 by activating an ignition device (an igniter). Burner 82 generates a quantity of heat by burning fuel gas supplied from gas supply pipe 91 (which is called a combustion operation).

Primary heat exchanger 83 is a heat exchanger for sensible heat recovery. This primary heat exchanger 83 mainly has a plurality of plate-shaped fins 83*b*, a heat conduction pipe 83*a* penetrating the plurality of plate-shaped fins 83*b*, and a case 83c accommodating fins 3*b* and heat conduction pipe 83*a*. Primary heat exchanger 83 exchanges heat with the combustion gas generated by burner 82, and specifically, it serves to heat hot water and water that flow through heat conduction pipe 83*a* of primary heat exchanger 83 with the quantity of heat generated as a result of the combustion operation of burner 82.

Secondary heat exchanger 84 is a heat exchanger for latent heat recovery. This secondary heat exchanger 84 is located downstream of primary heat exchanger 83 in a flow of the combustion gas and connected in series with primary heat exchanger 83. Since combustion apparatus 80 according to the present embodiment thus has secondary heat exchanger 84 for latent heat recovery, it serves as a water heater of a latent heat recovery type.

Secondary heat exchanger 84 mainly has a drainage water discharge port 84*a*, a heat conduction pipe 84*b*, a sidewall

84*c*, a bottom wall 84*d*, and an upper wall 84*g*. Heat conduction pipe 84*b* is stacked as it is spirally wound. Sidewall 84*c*, bottom wall 84*d* and upper wall 84*g* are arranged to surround heat conduction pipe 84*b*.

In secondary heat exchanger 84, hot water and water that flow through heat conduction pipe 84*b* is pre-heated (heated) through heat exchange with the combustion gas of which heat has been exchanged in primary heat exchanger 83. As a temperature of the combustion gas is lowered to approximately 60° C. through this process, moisture contained in the combustion gas is condensed so that latent heat can be obtained. In addition, latent heat is recovered in secondary heat exchanger 84 and moisture contained in the combustion gas is condensed, so that drainage water is produced.

Bottom wall 84*d* serves as a partition between primary heat exchanger 83 and secondary heat exchanger 84, and it also serves as an upper wall of primary heat exchanger 83. This bottom wall 84*d* is provided with an opening portion 84*e*, and this opening portion 84*e* allows communication between a space where heat conduction pipe 83*a* of primary heat exchanger 83 is arranged and a space where heat conduction pipe 84*b* of secondary heat exchanger 84 is arranged. As shown by hollow arrows in FIG. 17, the combustion gas can flow from primary heat exchanger 83 to secondary heat exchanger 84 through opening portion 84*e*. In the present embodiment, for the sake of simplification, although one common component is employed for bottom wall 84*d* of secondary heat exchanger 84 and the upper wall of primary heat exchanger 83, an exhaust collection and guide member may be connected between primary heat exchanger 83 and secondary heat exchanger 84.

Upper wall 84*g* is provided with an opening portion 84*h*, and this opening portion 84*h* allows communication between the space where heat conduction pipe 84*b* of secondary heat exchanger 84 is arranged and an internal space in exhaust box 85. As shown by hollow arrows in FIG. 17, the combustion gas can flow from secondary heat exchanger 84 into the internal space in exhaust box 85 through opening portion 84*h*.

Drainage water discharge port 84*a* is provided in sidewall 84*c* or bottom wall 84*d*. This drainage water discharge port 84*a* opens at a lowest position in the space surrounded by sidewall 84*c*, bottom wall 84*d* and upper wall 84*g* (the lowermost position in the vertical direction in the state where the water heater is placed), which is lower than the lowermost end portion of heat conduction pipe 84*b*. Thus, drainage water produced in secondary heat exchanger 84 can be guided to drainage water discharge port 84*a* along bottom wall 84*d* and sidewall 84*c* as shown by a black arrow in FIG. 17.

Exhaust box 85 forms a path for a flow of the combustion gas between secondary heat exchanger 84 and fan 86. This exhaust box 85 can guide, to fan 86, the combustion gas of which heat has been exchanged in secondary heat exchanger 84. Exhaust box 85 is attached to secondary heat exchanger 84 and located downstream of secondary heat exchanger 84 in the flow of the combustion gas.

Exhaust box 85 mainly has a box main body 85*a* and a fan connection portion 85*b*. An internal space in box main body 85*a* communicates through opening portion 84*h* in secondary heat exchanger 84 with the internal space where heat conduction pipe 84*b* of secondary heat exchanger 84 is arranged. Fan connection portion 85*b* is provided so as to protrude from an upper portion of box main body 85*a*. This fan connection portion 85*b* has, for example, a cylindrical shape, and an internal space 85*ba* thereof communicates with the internal space in box main body 85*a*.

Fan 86 serves to emit the combustion gas (of which heat has been exchanged in secondary heat exchanger 84), which has passed through secondary heat exchanger 84, to the outside of combustion apparatus 80 by suctioning the combustion gas. This fan 86 is located downstream of exhaust box 85 and secondary heat exchanger 84 in the flow of the combustion gas. Namely, in combustion apparatus 80, burner 82, primary heat exchanger 83, secondary heat exchanger 84, exhaust box 85, and fan 86 are arranged in this order from upstream to downstream in the flow of the combustion gas produced in burner 82. Since the combustion gas is suctioned and exhausted by means of fan 86 as above in this arrangement, combustion apparatus 80 in the present embodiment serves as a water heater of an exhaust suction and combustion type.

Fan 86 mainly has an impeller 86*a*, a fan case 86*b*, a drive source 86*c*, and a rotation shaft 86*d*. Fan case 86*b* is attached to fan connection portion 85*b* of exhaust box 85 such that the internal space in fan case 86*b* and the internal space in fan connection portion 85*b* communicate with each other. Thus, as shown by the hollow arrows in FIG. 17, the combustion gas can be suctioned from box main body 85*a* of exhaust box 85 through fan connection portion 85*b* into fan case 86*b*.

Impeller 86*a* is arranged in fan case 86*b*. This impeller 86*a* is connected to drive source 86*c* with rotation shaft 86*d* interposed therebetween. Thus, impeller 86*a* is provided with drive force from drive source 86*c* and can rotate around rotation shaft 86*d*. By rotation of impeller 86*a*, the combustion gas in exhaust box 85 can be suctioned from the inner circumferential side of impeller 86*a* and can be emitted to the outer circumferential side of impeller 86*a*.

Connection pipe 87 is connected to a region within fan case 86*b*, on the outer circumferential side of a region where impeller 86*a* is arranged. Therefore, the combustion gas emitted to the outer circumferential side of impeller 86*a* by impeller 86*a* of fan 86 can be emitted into exhaust tube 20 through connection pipe 87.

The combustion gas produced by burner 82 as above is suctioned by fan 86 by rotation of impeller 86*a* as above, so that the combustion gas can reach fan 86 after passage through primary heat exchanger 83, secondary heat exchanger 84 and exhaust box 85 in this order as shown by the hollow arrows in FIG. 17 and can be emitted to the outside of combustion apparatus 80.

Drainage water tank 88 serves to store drainage water produced in secondary heat exchanger 84. This drainage water tank 88 is connected to secondary heat exchanger 84 through pipe 90. Pipe 90 is connected to drainage water discharge port 84*a* of secondary heat exchanger 84. Thus, the drainage water produced in secondary heat exchanger 84 can be discharged to drainage water tank 88. A pipe 95 extending to the outside of combustion apparatus 80 is connected to drainage water tank 88. The drainage water stored in drainage water tank 88 can be discharged to the outside of combustion apparatus 80 through this pipe 95.

This drainage water tank 88 has a water seal structure. Namely, drainage water tank 88 has such a structure that, when a prescribed amount of drainage water is stored in drainage water tank 88, the stored drainage water cannot allow air to pass through drainage water tank 88. By such a water seal structure of drainage water tank 88, entry of air outside combustion apparatus 80 (outside air) into combustion apparatus 80 (secondary heat exchanger 84) through drainage water tank 88 via pipe 95 can be prevented.

It is to be noted that the lower portion of drainage water tank 88 is connected to a pipe 96 for discharging drainage water, separately from pipe 95. This pipe 96 (usually closed)

for discharging drainage water is designed such that drainage water within drainage water tank 88 that cannot be discharged through pipe 95 can be discharged by opening this pipe 96 during maintenance and the like. Furthermore, drainage water tank 88 has an internal space that may contain a neutralizing agent (not shown) for neutralizing acidic drainage water.

A water supply pipe 92 is connected to one end of heat conduction pipe 84*b* of secondary heat exchanger 84 and a hot water delivery pipe 93 is connected to one end of heat conduction pipe 83*a* of primary heat exchanger 83. The other end of heat conduction pipe 83*a* of primary heat exchanger 83 and the other end of heat conduction pipe 84*b* of secondary heat exchanger 84 are connected to each other through a pipe 94. Each of gas supply pipe 91, water supply pipe 92 and hot water delivery pipe 93 described above leads to the outside, for example, in a top portion of combustion apparatus 80. Burner 82, primary heat exchanger 83, secondary heat exchanger 84, exhaust box 85, fan 86, drainage water tank 88, and the like are arranged in housing 89.

Housing 89 has a connection portion 89*a* and an exhaust portion 89*b*. Specifically, housing 89 has an upper surface provided with tubular connection portion 89*a* and tubular exhaust portion 89*b* that are concentrically arranged and protrude in the upward direction. In other words, connection portion 89*a* and exhaust portion 89*b* form a double-pipe structure.

Connection portion 89*a* is provided so as to surround the outer circumferential surface of exhaust portion 89*b*. Furthermore, a connection hole is provided in a region of housing 89 between the outer circumferential surface of exhaust portion 89*b* and the inner circumferential surface of connection portion 89*a*. An exhaust port is provided inside exhaust portion 89*b* of housing 89. The above-mentioned connection hole communicates with the inside of housing 89 while the above-mentioned exhaust port communicates with the inside of connection pipe 87. Accordingly, a gap provided between the outer circumferential surface of exhaust tube 20 and the inner circumferential surface of connection pipe 60 communicates with the internal space of housing 89 through the connection hole provided in housing 89. Furthermore, the combustion gas having flown through burner 82 is sent from connection pipe 87 to exhaust tube 20 via exhaust portion 89*b*.

Connection portion 89*a* is connected to connection pipe 60 on the one end portion side of connection pipe 60 while exhaust portion 89*b* is connected to exhaust tube 20 on the one end portion 20*a* side thereof. In addition, exhaust portion 89*b* is connected also to connection pipe 87 housed within housing 89. For example, exhaust portion 89*b* is formed to protrude also downward in a tubular manner from the upper surface of housing 89, so that exhaust portion 89*b* and connection pipe 87 can readily be connected to each other.

Connection portion 89*a* and connection pipe 60 only have to be connected to each other so as to prevent leakage of the gas flowing therethrough. Similarly, exhaust portion 89*b* and exhaust tube 20 (and connection pipe 87) only have to be connected to each other so as to prevent leakage of the gas flowing therethrough. Accordingly, an O-ring may be interposed between these components connected to each other, or these components may be firmly bound using a binding band. It is to be noted that connection between these components may be implemented by an inner cover or an outer cover.

Then, the functions and effects of the present embodiment will be described.

As shown in FIGS. 2 and 3, according to closing member 10 in the present embodiment, flange portion 12 is formed to protrude toward the outer side such that its entire circumference extends beyond the outer circumferential surface of tip end portion 30*a* of exhaust pipe 30. Accordingly, flange portion 12 comes in contact with tip end portion 30*a* of exhaust pipe 30, so that the gap between exhaust pipe 30 and exhaust tube 20 can be closed. Thereby, the outside air can be suppressed from entering through the gap between tip end portion 30*a* of exhaust pipe 30 and exhaust tube 20, so that the outside air can be suppressed from entering through the gap between exhaust pipe 30 and exhaust tube 20 on the outside of the building.

Furthermore, flange portion 12 is formed to protrude toward the outer side such that its entire circumference extends beyond the outer circumferential surface of tip end portion 30*a* of exhaust pipe 30. Accordingly, even when the center of closing member 10 in the radial direction is displaced from the center of exhaust pipe 30 in the radial direction, flange portion 12 can still cover tip end portion 30 of exhaust pipe 30. Thereby, the gap between tip end portion 30*b* of exhaust pipe 30 and exhaust tube 20 can be reliably closed.

As shown in FIGS. 3 and 4, according to closing member 10 in the present embodiment, annular portion 11 includes a first annular member 111 and a second annular member 112 that is larger in outer diameter than first annular member 111. Thereby, as shown in FIGS. 5 and 7, each of first annular member 111 and second annular member 112 can be arranged inside various exhaust pipes 30 with different sizes (for example, 3 inches and 4 inches), and therefore, can be adapted to various exhaust pipes 30 with different sizes.

Therefore, since one closing member 10 can be adapted to various exhaust pipes 30 with different opening diameters, the manufacturing cost for closing member 10 can be reduced as compared with the case where closing member 10 is exchanged each time when exhaust pipe 30 with a different opening diameter is used. Furthermore, when closing member 10 is exchanged each time when exhaust pipe 30 with a different opening diameter is used, closing member 10 not used in the installation site is to be discarded. Thus, if the same closing member 10 can be used, closing members 10 to be discarded can be reduced.

As shown in FIGS. 3 and 4, in closing member 10 in the present embodiment, first annular member 111 is arranged on the first side of flange portion 12 and second annular member 112 is arranged on the second side of flange portion 12 that is opposite to the first side. Thereby, as shown in FIGS. 5 and 7, each of first annular member 111 arranged on the first side of flange portion 12 and second annular member 112 arranged on the second side of flange portion 12 can be arranged inside various exhaust pipes 30 with different sizes.

As shown in FIGS. 8 to 11, in closing member 10 in the first modification of the present embodiment, flange portion 12 includes a first flange member 121 and a second flange member 122 that is larger in outer diameter than first flange member 121. First annular member 111 is arranged on the first side of first flange member 121 and second annular member 112 is arranged on the second side of first flange member 121 that is opposite to the first side. First flange member 121 is arranged on the first side of second annular member 112 and second flange member 122 is arranged on the second side of second annular member 112 that is opposite to the first side of second annular member 112. Thereby, first annular member 111 can be arranged inside exhaust pipe 30 while first flange member 121 is in contact with tip end portion 30*a* of exhaust pipe 30. Also, second annular member 112 can be arranged inside exhaust pipe 30 while second flange member 122 is in contact with tip end portion 30*a* of exhaust pipe 30.

As shown in FIGS. 12 and 13, in closing member 10 in the second modification of the present embodiment, flange portion 12 is provided with a first annular groove H1. First annular groove H1 surrounds a through hole 10*c*, and is provided in the end face of flange portion 12 near first annular member 111. Thereby, flange portion 12 is cut along first annular groove H1, so that second annular member 112 can be separated from flange portion 12.

As shown in FIGS. 14 and 15, in closing member 10 in the third modification of the present embodiment, first annular member 111 is provided with a second annular groove H2. Second annular groove H2 surrounds through hole 10*c*, and is provided in the end portion of first annular member 111 near flange portion 12. Thereby, first annular member 111 is cut along second annular groove H2, so that first annular member 111 can be separated from flange portion 12.

As shown in FIGS. 1 and 2, according to exhaust structure for combustion apparatus 100 in the present embodiment, closing member 10 can suppress the outside air from entering through the gap between exhaust pipe 30 and exhaust tube 20 on the outside of the building. Furthermore, since rain cap 70 covers the top of closing member 10, moisture such as rain can be suppressed from entering exhaust pipe 30 through between through hole 10*c* of closing member 10 and the outer circumferential surface of exhaust tube 20.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. A closing member for closing a gap, on an outside of a building, between an exhaust pipe extending from inside to outside of the building and an exhaust tube inserted into the exhaust pipe, the closing member comprising:

an annular portion provided with a through hole and being in contact with an outer circumferential surface of the exhaust tube in at least a part of the through hole; and a flange portion extending from an outer circumferential surface of the annular portion toward an outer side and being larger in outer diameter than the exhaust pipe, the flange portion contacting a tip end portion of the exhaust pipe on outside of the building so as to close a gap between the exhaust pipe and the exhaust tube, the flange portion being formed to protrude toward the outer side such that an entire circumference of the flange portion extends beyond an outer circumferential surface of the tip end portion of the exhaust pipe.

2. The closing member according to claim 1, wherein the annular portion includes a first annular member and a second annular member that is larger in outer diameter than the first annular member.

3. The closing member according to claim 2, wherein the first annular member is arranged on a first side of the flange portion and the second annular member is arranged on a second side of the flange portion that is opposite to the first side of the flange portion.

4. The closing member according to claim 2, wherein the flange portion includes a first flange member and a second flange member that is larger in outer diameter than the first flange member, the first annular member is arranged on a first side of the first flange member and the second annular member is arranged on a second side of the first flange member that is opposite to the first side of the first flange member, and the first flange member is arranged on a first side of the second annular member and the second flange member is arranged on a second side of the second annular member that is opposite to the first side of the second annular member.

5. The closing member according to claim 2, wherein the flange portion is provided with a first annular groove, and the first annular groove surrounds the through hole and is provided in an end face of the flange portion near the first annular member.

6. The closing member according to claim 2, wherein the first annular member is provided with a second annular groove, and the second annular groove surrounds the through hole and is provided in an end portion of the first annular member near the flange portion.

7. An exhaust structure for combustion apparatus, comprising:

the closing member according to claim 1;

the exhaust tube having one end portion and an other end portion, the exhaust tube being connected at the one end portion to a combustion apparatus;

the exhaust pipe through which the exhaust tube is inserted; and a rain cap attached to the other end portion of the exhaust tube and covering a top of the closing member, the annular portion of the closing member being attached to an outer circumference of the exhaust tube, and the flange portion being held in the tip end portion of the exhaust pipe.

* * * * *